US006565711B1

(12) United States Patent
Kleissler, Jr.

(10) Patent No.: US 6,565,711 B1
(45) Date of Patent: May 20, 2003

(54) METHOD FOR CONTROLLING DUST ON PAPER MACHINERY AND THE LIKE

(76) Inventor: Edwin A. Kleissler, Jr., 234 Washington Ave., Avon By The Sea, NJ (US) 07717

( * ) Notice: Subject to any disclaimer, the term of this patent is extended or adjusted under 35 U.S.C. 154(b) by 201 days.

(21) Appl. No.: 09/634,602

(22) Filed: Aug. 5, 2000

(51) Int. Cl.[7] ..... B08B 5/00; D21F 1/36

(52) U.S. Cl. ..... 162/199; 134/15; 134/37

(58) Field of Search ..... 162/199, 272; 134/122 R, 15, 37; 34/114, 117, 641, 413, 414; 226/97, 3, 7, 91; 15/300.1, 309.1, 316.11

(56) References Cited

U.S. PATENT DOCUMENTS 4,290,784 A * 9/1981 Rawicki ..... 55/95
4,906,333 A * 3/1990 Myren ..... 162/111
5,466,298 A * 11/1995 Pollock ..... 134/15
5,577,294 A * 11/1996 Pollock ..... 15/345
5,635,031 A * 6/1997 Enkvist ..... 162/199
5,759,352 A * 6/1998 Lau et al. ..... 162/272
5,800,679 A * 9/1998 Lindstrom et al. ..... 162/272
6,033,303 A * 3/2000 Green et al. ..... 454/252
6,068,735 A * 5/2000 Marchal ..... 162/272
6,148,831 A * 11/2000 Lindstrom et al. ..... 134/21
6,176,898 B1 * 1/2001 Courtney et al. ..... 95/216
6,193,846 B1 * 2/2001 Lelmu ..... 162/199
6,328,852 B1 * 12/2001 McGary et al. ..... 162/199
2002/0069984 A1 * 6/2002 Nissinen ..... 162/50

* cited by examiner

*Primary Examiner*—Jose A. Fortuna
(74) *Attorney, Agent, or Firm*—Schnader Harrison Segal & Lewis LLP

(57) ABSTRACT

A method for controlling dust on paper machinery and the like is shown. A foil, a baffle and an exhaust are used to direct contaminated air away from the machinery and the sheet or web of material running through the machinery. Thus the deleterious effect of the contaminants is minimized and contained.

4 Claims, 3 Drawing Sheets

METHOD FOR CONTROLLING DUST ON PAPER MACHINERY AND THE LIKE

The present invention relates to controlling dust and other contaminants on paper machinery or similar apparatus.

BACKGROUND OF THE INVENTION

A necessary step in presently known paper making, tissue making and similar machinery is the drying of the moist paper web on a drum, known as a "Yankee dryer." The heated Yankee dryer rotates constantly, with wet paper web being taken up at one spot on the rotation, and being dried before being scraped off the dryer at another spot in the rotation. After being scraped off the dryer, the web usually passes through a sensor, measuring the moisture and thickness of the web, and then is taken up by a reel drum.

The paper web is scraped off the Yankee dryer by a blade known as a "creping doctor." Usually following the creping doctor is a "cleaning doctor," which removes any stray material that was left after the paper web is scraped off the dryer. Finally, the dryer is sprayed with a coating prior to taking up a new section of paper web.

The creping and cleaning operations create dust, in the form of fibers, tendrils, tiny scraps of paper, etc. Other locations in the machinery also create dust as a byproduct of the operation. The greatest quantity of dust is usually generated below the paper web sheet because of the action of the creping doctor and the cleaning doctor. Controlling the dust is important. Dust can detrimentally affect workers' health, create a fire hazard, ruin the machinery, and interfere with the sensor 's operation.

The dust is not the only undesirable byproduct of the operation. Excess moisture, released from the drying, the cleaning and coating solutions or other sources can also adversely affect the operation.

The prior art has attempted to control dust by a variety of methods. The majority of these methods involve attempting to collect dust at or very near the creping doctor. See, e.g., U.S. Pat. No. 4,019,953. However, almost invariably, the means used are ineffective because the prior art devices make no allowance for the moisture generated by the paper making procedure. This moisture will clog the dust control devices used by the prior art and so interfere with the dust take-up. A clogged device cannot remove dust from the machinery. This is especially true for the prior art devices which attempt to control the dust at the creping doctor blade. These devices are impractical and quickly fail because of the moisture in the creping doctor blade area which quickly clogs an exhaust hood or other dust control method. Thus, the prior art has failed to solve the problem of moisture-associated clogging in paper making and similar machinery.

Moreover, a substantial amount of dust and other contaminants is carried by one or more "boundary layers" along the web, after the web has been creped off the Yankee dryer. A boundary layer is usually from four to six inches thick, and located along the top and bottom of the web, with the bottom boundary layer usually carrying the majority of the dust and contaminants. Heretofore, boundary layer dust has not been adequately captured or eliminated from the system. Nor has the prior art adequately controlled dust that originally was carried by a boundary layer and subsequently sloughs off the boundary layer as the web travels towards the reel drum.

Accordingly, it is an object of the present invention to control both dust and moisture in paper machinery and the like.

It is a further object of the present invention to control both dust and moisture simply and efficiently.

It is a further object of the present invention to control both dust and moisture through apparatus and methods that can be added to already existing machinery.

It is a further object of the present invention to control boundary layer dust and moisture.

SUMMARY OF THE INVENTION

The present invention comprises methods and apparatus for controlling dust. In the preferred embodiments, a foil, an air ramp, a baffle, and exhaust hood are provided to the underside of the web after it is creped off the Yankee dryer. The foil separates the boundary layer air containing dust and moisture and, at the same time, provides web stability. The foil directs the air to an air ramp, which in turn directs the air along the baffle into an exhaust hood. A cleaning jet prevents the dust from sticking to the interior surface of the exhaust hood and an external exhaust system may then remove the moist dust from the exhaust hood.

In especially preferred embodiments, the foil is comprised of porous metal, and is internally pressurized. That pressurization provides air flow through the porous metal and creates an "air lubricant" for the web.

DETAILED DESCRIPTION OF THE PREFERRED EMBODIMENTS

Figure 1:
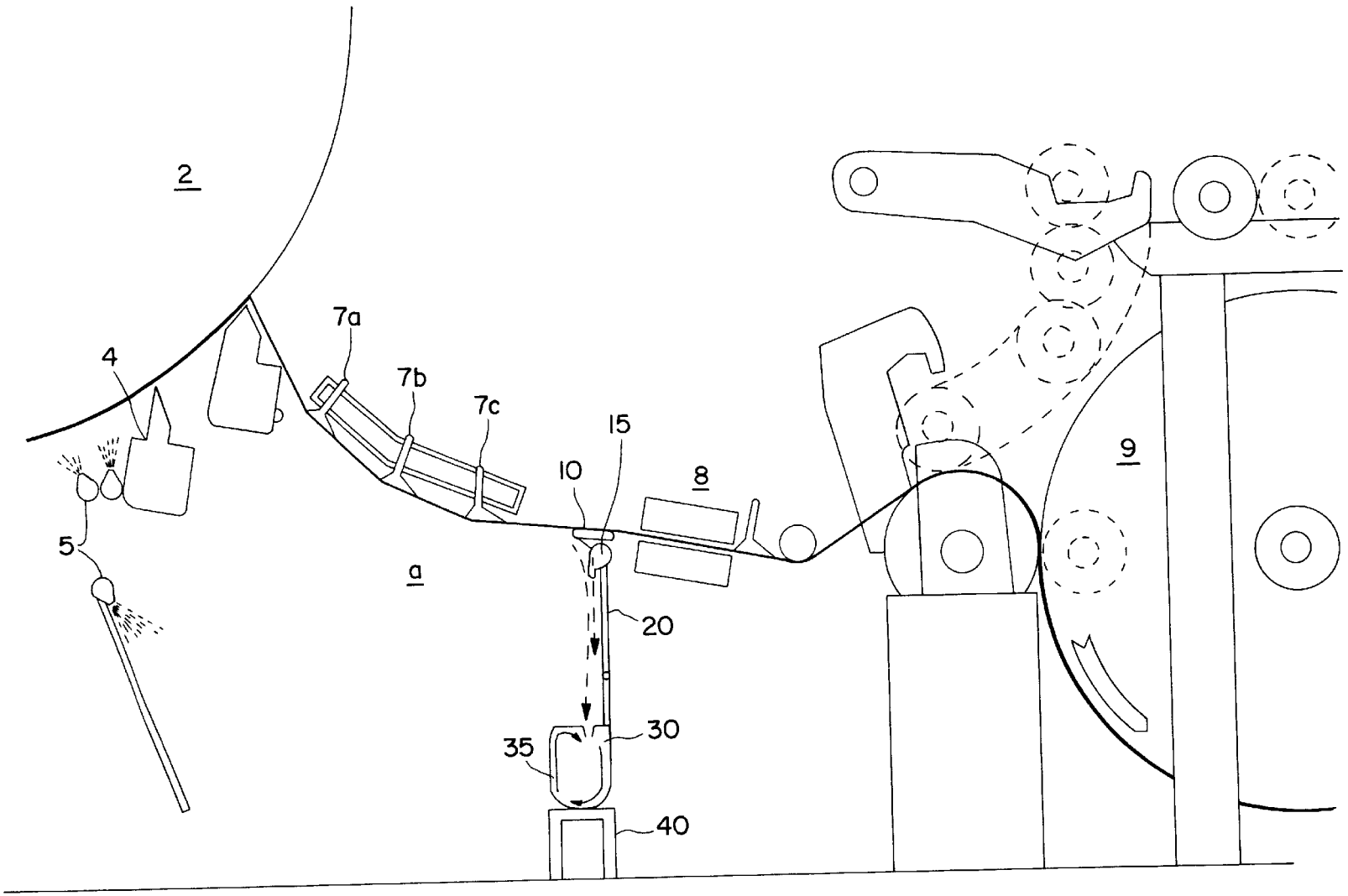
FIG. 1 shows a view of a preferred embodiment installed on a paper making machine.

FIG. 1 shows a view of a preferred embodiment installed on a typical paper machine. "Paper machine" and "paper machinery" are used throughout to designate paper machinery and other similar machinery such as tissue making machinery.

The Yankee dryer of the paper machine is shown at 2. A creping doctor 3, crepes the tissue web or sheet off the dryer. ("Web" and "sheet" are used interchangeably throughout.) Following the creping doctor 3 is a cleaning doctor 4 as well as sprays 5 used for applying cleaning and coating solutions. The sheet, with its attendant boundary layer dust and moisture, shown generally at a, passes by a number of stations, such as upper foils 7*a*, 7*b* and 7*c*, foil 10, sensor 8, and various other stations on the way to a reel drum shown generally at 9. The air carried along with the sheet, as well as any unbalanced exhaust present above or below the sheet, may cause edge curl and other instability. The foils help in minimizing this instability.

Figure 2:
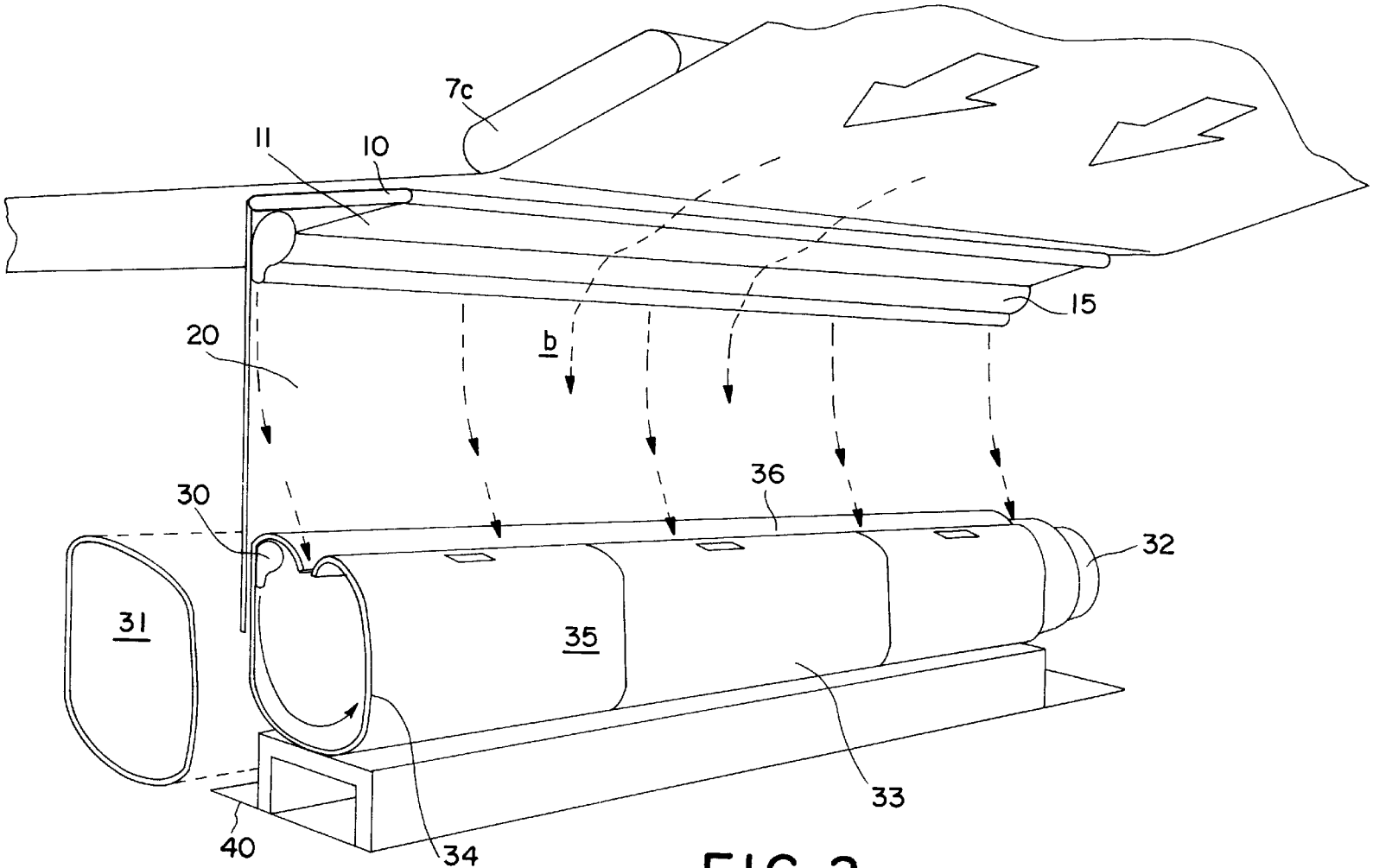
FIG. 2 shows a front view of the embodiment of FIG. 1.

Near foil 10 is a directional air jet 15, a baffle 20, a hood surface cleaning air nozzle 30, a lower sensor hood 35, and a support 40. Turning now to FIG. 2 these components are seen in greater detail. The web passes below upper foil 7*c* and above foil 10; its direction of travel is shown by the arrows. Foil 10 directs the boundary layer laden with dust away from the sheet. ("Dust" is used throughout as including dust and other contaminants.)

In certain embodiments, the foil 10 is made of solid metal. In especially preferred embodiments, the foil is made of porous metal. The porous metal foil, which is usually stainless steel, has pore sizes on any particular embodiment ranging from 1 to 100 microns. Mounted at the edge of foil

10 is an air jet 11. Air jet 11 introduces air flow into the porous metal foil. This air flow creates a high pressure region within foil 10 which causes air flow out of the pores of the porous metal foil. This air flow through the porous metal foil generates an "air lubricant," which reduces friction when the sheet passes over the foil. The reduction in friction and associated drag permits higher sheet speeds through the machinery. Because the porous metal foil helps the sheet to travel at higher speeds, the machinery can operate faster, and make more paper or other product faster than would otherwise be the case. Thus the porous metal foil can help in increasing production speed. The desired amount of lubricant will depend upon the porosity of the foil and the weight of the sheet and so air jet 11 is, in this embodiment, adjustable.

The path of the boundary layer air shown generally at b is under foil 10. The boundary layer air then mixes with the air ramp air 15, is directed through the baffle 20, and into the slot 36 on the exhaust hood 35. The air, laden with dust and moisture, is then exhausted by way of dust control hood exhaust 32. The exhaust hood 35 has a number of features in this embodiment to assist in cleaning any residual dust and moisture. There is a surface cleaning air nozzle 30 of a type known in the art which creates a constant flow throughout the inside surface of the exhaust hood 35. Additionally, removable end plate 31 as well as access doors 33 may be used to access the inside of exhaust hood 35 and so assist in the cleaning operation if necessary. The rounded hood plenum 34 allows smooth flow of cleaning nozzle air along the surface.

It should be noted that the embodiment of FIGS. 1 and 2 provides for portable operation. This embodiment can be placed anywhere along a sheet in order to permit the greatest usability. If desired more than one embodiment can be installed on a web.

Figure 2A:
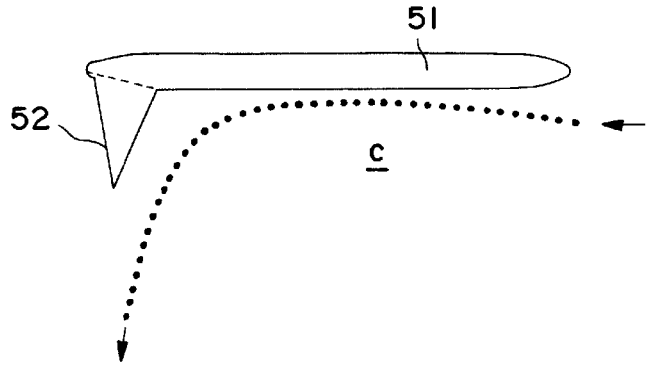
FIG. 2*a* shows a view of an alternative embodiment.

In certain preferred embodiments, the foil 10 has a more or less rectangular or flat cross section with rounded corners. This shape helps separate the boundary layer from the tissue sheet. However, it should be noted other foil shapes known in the art, such as an oval or aircraft wing cross section, can be used. Moreover in other embodiments the foil structure can comprise both a foil and an air ramp. FIG. 2*a* shows such a foil shape with the foil 51 and air ramp 52 being separately chambered. The air is directed generally along path c.

Generally, in various embodiments of the present invention, the air coming from the foil structure is directed through the baffle, which in turn directs the air to the exhaust. The baffle can comprise a ramp or other directional structure, in various embodiments. In those embodiments, the word "through" is used to designate directing the air along or down the baffle, as appropriate. In other embodiments, the baffle may be integral with and connected to the foil structure and/or the exhaust structure.

It will usually be desired to place any embodiments so as to capture the dust in the boundary layer several feet downstream from the creping doctor where the amount of moisture is sharply reduced. It should be noted that foils can be placed on top and on the bottom of the sheet in various arrangements. The offsetting bottom and top foils of FIGS. 1 and 2 is one such arrangement. In the various embodiments of the present convention, the foil or foils can be comprised of porous metal with any method known in the art used to increase the internal pressure of the foil(s) and thus emit air from the pores and so provide an air lubricant or lubricants to the sheet.

Figure 3:
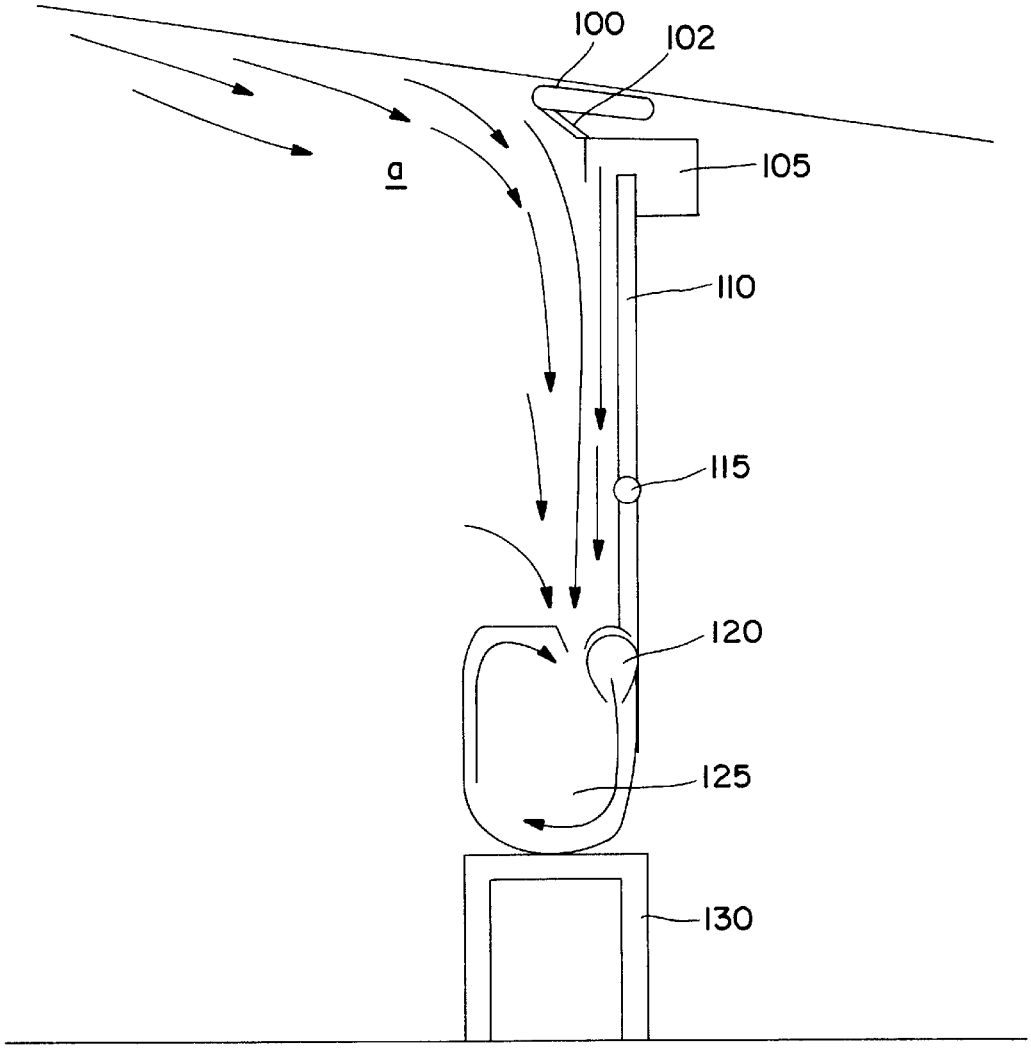
FIG. 3 shows a side view of another embodiment of the invention.

FIG. 3 shows a side view of another embodiment of the invention. The foil 100 has flexible connection 102 to baffle 110. Flexible connection 102 is through means known in the art, for example, hinges or similar means. In this embodiment, as well as in others, the flexible connection 102 permits foil 100 to be retractable vertically downward when threading the web through the machinery.

The boundary layer, laden with dust and moisture, travels generally along the path seen at a. In this embodiment, the baffle is hinged for access and in order to increase visibility if desired. It also may be desired, in some embodiments, to include walls along the sides of the baffle, in order to minimize the leakage of any airflow. These walls may of course be removable and/or flexibly connected to the baffle.

This embodiment uses jet plenum air ramp 105 with an orifice directed downward to entrain boundary layer laden dust and moisture which cannot get past foil 100 and flexible connector 102. The baffle 110 generally helps to reduce the downward force needed to be applied by jet plenum 105. Of course, other means known in the art to assist boundary layer flow may be used in other embodiments. Additionally, in other embodiments, a jet plenum air ramp or other means known in the art to assist boundary layer flow can be included within the foil structure.

A small volume high velocity vortex cleaning jet 120 is used in this embodiment inside exhaust hood 125 to assist cleaning and to keep heavier moist dust from settling on the bottom of the hood. Support 130 is provided as well.

Exhaust hood 125 is shaped to maximize the cleaning action of the vortex jet 120 inside the exhaust hood. The shape of exhaust hood 125 also helps prevent the vortex jet from being directed out of the exhaust hood slot.

The above description and the views and material depicted by the figures are for purposes of illustration only and are not intended to be, and should not be construed as, limitations on the invention.

Moreover, certain modifications or alternatives may suggest themselves to those skilled in the art upon reading of this specification, all of which are intended to be within the spirit and scope of the present invention as defined in the attached claims.

I claim:

1. A method for controlling contamination in paper making machinery with a sheet traveling throughout the machinery, and air traveling attendant to the sheet, comprising the steps of first, directing said air about a foil means to a baffle means, second, directing said air through said baffle means to an exhaust means, and third, exhausting said air through said exhaust means wherein said foil means is porous and said sheet is lubricated with air flowing through said porous as said sheet is passed over said foil means; wherein contamination in said paper machine.

2. The method of claim 1 further comprising the step of applying pressure to the inside of said porous foil means.

3. The method of claim 1 further comprising the step of exhausting said air by way of an exhaust hood means.

4. The method of claim 3 further comprising the step of cleaning said exhaust hood means by way of a vortex jet means.

* * * * *